US008512171B1

(12) United States Patent
Minotti

(10) Patent No.: US 8,512,171 B1
(45) Date of Patent: Aug. 20, 2013

(54) BATTER TRAINING APPARATUS AND METHOD

(76) Inventor: David Minotti, Horseheads, NY (US)

( * ) Notice: Subject to any disclaimer, the term of this patent is extended or adjusted under 35 U.S.C. 154(b) by 0 days.

(21) Appl. No.: 13/113,322

(22) Filed: May 23, 2011

Related U.S. Application Data

(60) Provisional application No. 61/396,452, filed on May 27, 2010.

(51) Int. Cl.
*A63B 69/00* (2006.01)

(52) U.S. Cl.
USPC ..... 473/451; 473/457; 473/452; 473/422

(58) Field of Classification Search
USPC ..... 473/422, 437, 457, 451, 453, 229, 473/458, 212, 213; D21/694, 753, 721; 482/109, 121, 122
See application file for complete search history.

(56) References Cited

U.S. PATENT DOCUMENTS

| | | | | | |
|---|---|---|---|---|---|
| 667,563 | A | * | 2/1901 | Oakley | 473/424 |
| 1,561,960 | A | * | 11/1925 | Ungar | 473/216 |
| 2,134,451 | A | * | 10/1938 | Mogren | 482/94 |
| 3,436,076 | A | * | 4/1969 | Barthol | 473/457 |
| 3,618,942 | A | * | 11/1971 | Bates et al. | 482/129 |
| 3,652,085 | A | * | 3/1972 | Cole | 482/129 |
| 4,225,133 | A | * | 9/1980 | Kiray | 473/457 |
| 4,328,964 | A | * | 5/1982 | Walls | 482/129 |
| 4,544,155 | A | * | 10/1985 | Wallenbrock et al. | 482/129 |
| 4,600,190 | A | * | 7/1986 | Berokoff | 482/129 |
| 5,009,420 | A | | 4/1991 | Martelli | |
| 5,082,262 | A | * | 1/1992 | Sanchez | 473/458 |
| 5,269,512 | A | * | 12/1993 | Crowson et al. | 473/457 |
| 5,288,074 | A | * | 2/1994 | Scheurer | 473/277 |
| 5,704,856 | A | * | 1/1998 | Morse | 473/422 |
| 6,120,418 | A | | 9/2000 | Plough | |
| 6,245,002 | B1 | * | 6/2001 | Beliakov | 482/148 |
| 6,413,196 | B1 | * | 7/2002 | Crowson | 482/118 |
| 6,572,497 | B1 | * | 6/2003 | Halsworth | 473/453 |
| 6,612,845 | B1 | | 9/2003 | Macri et al. | |
| 6,786,855 | B2 | | 9/2004 | Prichard | |
| 6,884,187 | B2 | * | 4/2005 | Cataldi et al. | 473/451 |
| D576,231 | S | * | 9/2008 | Rasmussen et al. | D21/694 |
| 7,438,653 | B2 | | 10/2008 | Anderson | |
| 7,625,320 | B2 | | 12/2009 | Wehrell | |
| 7,651,450 | B2 | | 1/2010 | Wehrell | |

(Continued)

OTHER PUBLICATIONS

Christian M. Welch,et al. Hitting a Baseball: A Biomechanical Description Journal of Orthopaedic and Sports Physical Therapy Official Publication of the Orthopaedic and Sports Physical Therapy Sections of the American Physical Therapy Association.

*Primary Examiner* — Mitra Aryanpour
(74) *Attorney, Agent, or Firm* — Goldstein Law Offices, P.C.

(57) ABSTRACT

A batter training apparatus and method for training batters to attain optimal biomechanics for most effectively hitting a ball, with a proper rotation of a batter's hips and proper follow through with a batter's arms, wrists and shoulders. The training apparatus includes a belt worn over the hips that has a cable extending behind and between the hips. A tether connects the belt to a support post, preventing forward motion of the batter's body, but allowing and conditioning the hips to rotate. The support post sits at the rear of a platform that is about the size of a batter's box. An elastic cord connected to a forward arm and attached to the front of the platform, pulls a batter's wrists, arms and shoulders forward during proper follow through, conditioning the batter to swing the bat efficiently.

6 Claims, 5 Drawing Sheets

(56) References Cited

U.S. PATENT DOCUMENTS 7,677,992 B2 * 3/2010 Moos ..... 473/453
7,762,913 B1 * 7/2010 Hagen et al. ..... 473/457
7,811,185 B1 * 10/2010 Reynolds ..... 473/453
2010/0125011 A1 * 5/2010 Capps ..... 473/451
2011/0212797 A1 * 9/2011 Adkins ..... 473/451

* cited by examiner

BATTER TRAINING APPARATUS AND METHOD

CROSS-REFERENCE TO RELATED APPLICATIONS

This application is a nonprovisional utility application of the provisional patent application Ser. No. 61/396,452 filed in the United States Patent Office on May 27, 2010 and claims the priority thereof.

BACKGROUND OF THE INVENTION

The invention relates generally to a training apparatus and method for training batters. More particularly, the invention relates to an apparatus and method to train baseball and softball batters to effectively swing the bat with a proper rotation of a player's hips and proper follow through of a player's wrist, arm and shoulder.

To acquire any physical skill, a player must endlessly repeat the motions involved in that skill so that the muscles are conditioned and develop a "memory" for the specific pattern of movement. The player begins by consciously following instructions for the specific pattern and repeats until the movements are executed unconsciously. Unfortunately, if the player improperly learns the movement pattern by repeating a pattern that is not optimal, it becomes very difficult to break the neuromuscular memory already established in order to then improve the player's performance. Optimally, with the right coaching and constant supervision, a young player learns the movements correctly from the beginning. More typically and for most players, however, the longer they play, the more likely they will develop non-optimal habits that they will need to unlearn in order to relearn the proper motions to improve their performance.

It has been demonstrated that hitting a ball when playing baseball or softball follows rather specific bio-mechanical principles. Specifically, hitting the ball properly requires rotational movement of segments of a player's body around the axis of a player's trunk. For a right-handed batter, a right hip must start its rotation first, in a counterclockwise direction, followed by a right shoulder, which moves a right arm and wrist. The arm and the wrist must follow through, connecting the bat to the ball when the bat is parallel to the pitcher's rubber. When properly executed, the batter fully incorporates the power of his or her body to maximize the distance the ball travels after the bat connects with the ball.

Along with properly rotating hips and following through with sufficient rotation of the arms, the batter must maintain the proper linear forward motion. The batter's body must be aligned and parallel with an imaginary axis that runs from the pitcher's rubber to home plate, parallel to the surface of the batter's box. Any forward motion must be along that axis. However, if the batter applies the force of the forward motion to move his or her body forward in the batter's box rather than apply all forward force to the bat, the swing is less powerful. This rotation of the hips and follow through of the arms are equally important to an efficient golf swing, apply the force with the club, directed toward the club face striking the ball for optimal lift and forward motion.

Systems to train, retrain and rehabilitate batters have been developed. For hitting a ball with a bat or golf club, these systems focus on the rotational movement of the hips. Some of these devices are for building strength in the muscles that rotate the hips by providing resistance through a training belt attached to resilient tethers or a torsion spring. Many training devices require elaborate systems of adding resistance to the hip tethers by adding elastic means. Some focus on other rotational segments of the user, such as the thighs and shoulder. None provide any training mechanism for the arm and wrist.

While these units may be suitable for the particular purpose employed, or for general use, they would not be as suitable for the purposes of the present invention as disclosed hereafter.

SUMMARY OF THE INVENTION

It is an object of the invention to produce a training apparatus that conditions a user, having a pair of hips, to rotate the hips properly. Accordingly, the batter training apparatus has a training belt with a cable that extends behind and between the user's hips, the cable tethered to a post, that encourages and conditions the user to fully and properly rotate the hips.

It is another object of the invention to produce a training apparatus that conditions a user, having a pair of hips, to rotate the hips in a plane parallel to the ground. Accordingly, the batter training apparatus has a training belt with a cable attached by a tether line to a support post so that the tether line moves substantially in a plane parallel to the ground, the training belt and tether line allows the user to only rotate his hips axially, in the plane parallel to the ground.

It is a further object of the invention to produce a training apparatus that conditions a user to apply all forward force on the bat. Accordingly, the batter training apparatus has a training belt that is attached by a tether line that prevents any forward motion of the user so that all forward force is applied through the bat.

It is yet another object of the invention to produce a training apparatus that conditions a user to correctly swing a bat with proper follow through of a user's arm, wrist and shoulder. Accordingly, the batter training apparatus has an elastic cord that connects to a front corner of a platform and to the bat or wrist of the batter, the tension of the elastic cord pulling and directing the batter's wrist, arm and shoulder forward to properly follow through during the swing.

The invention is a batter training apparatus and method to train baseball and softball batters to attain optimum biomechanics for most effectively hitting a ball with a bat, using proper rotation of the batter's hips and proper follow through of the batter's arms, wrists and shoulders. The training apparatus includes a platform that is about the size of a batter's box, a support post extending upwardly from the rear of the platform, and a belt worn on the waist over the hips of a batter, having a cable extending behind and between the hips. The support post sits at the rear of a platform that is about the size of a batter's box. A tether connects the cable extending behind the belt and the support post by a pulley, preventing forward motion of the batter's body, while allowing and conditioning the hips to rotate. The training apparatus has an elastic cord attaching to the front of the platform and to the bottom of the bat or the wrist of the batter. The elastic cord pulls the batter's wrists, arms and shoulders for proper follow through, conditioning the batter to swing the bat efficiently.

To the accomplishment of the above and related objects the invention may be embodied in the form illustrated in the accompanying drawings. Attention is called to the fact, however, that the drawings are illustrative only. Variations are contemplated as being part of the invention.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 4:
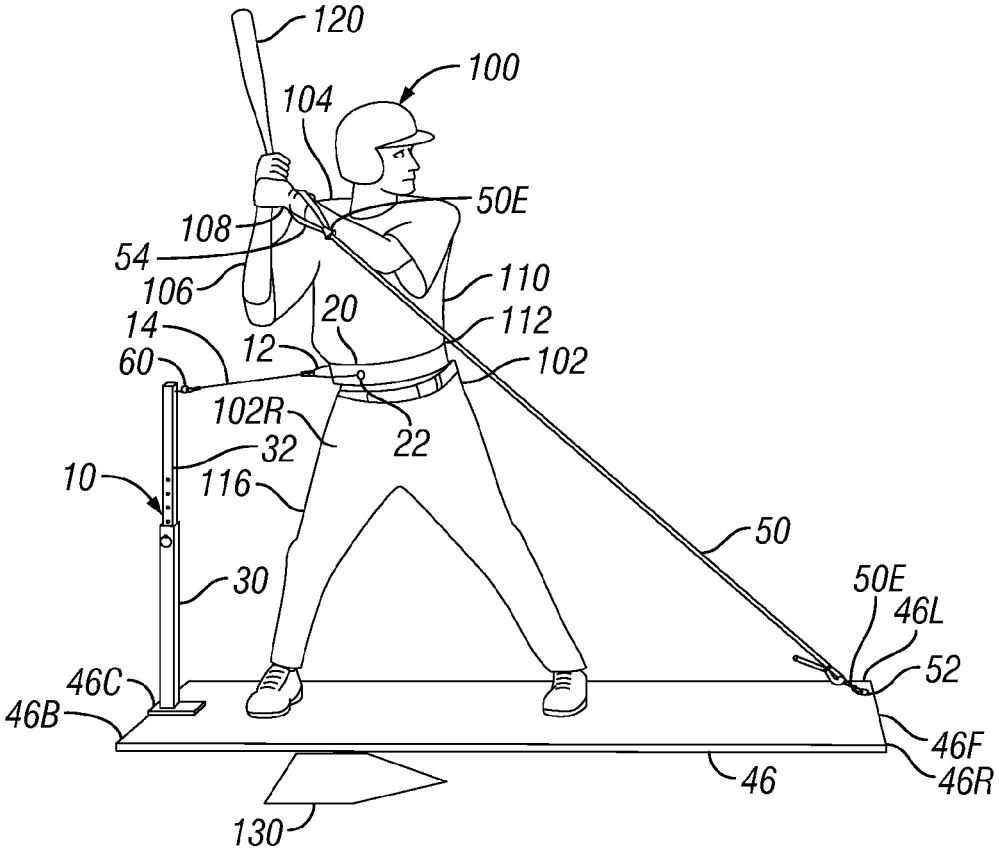
FIG. 4 is a diagrammatic perspective view of a batter poised in a proper position in anticipation of swinging the bat, standing on a platform for the support post.
Figure 5:
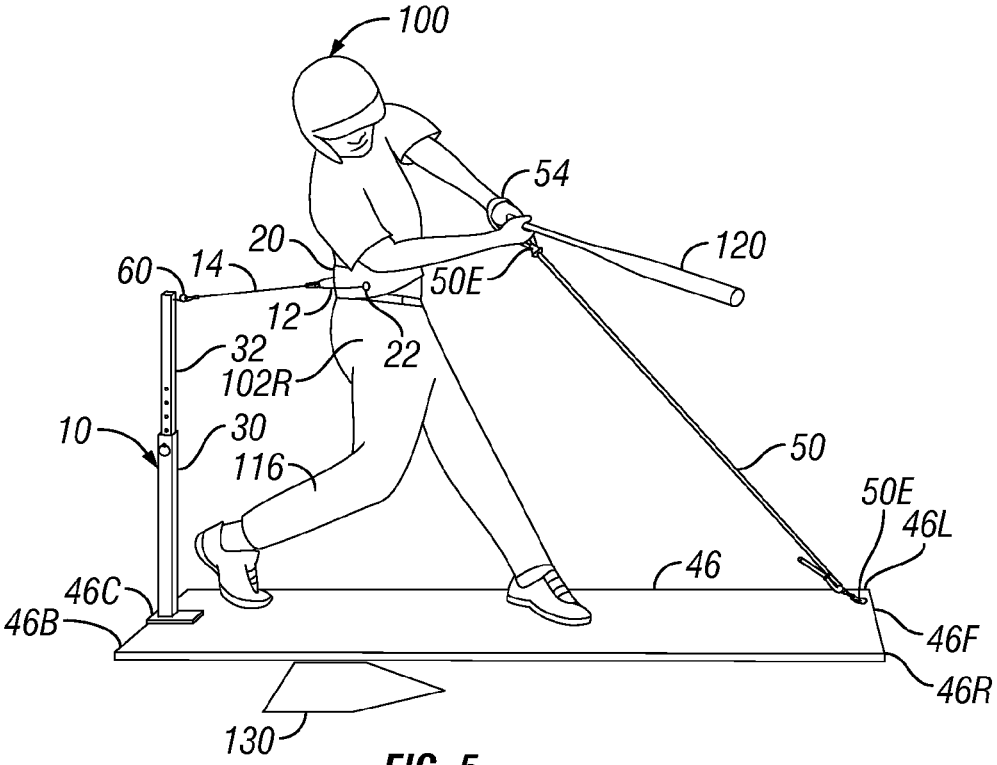
FIG. 5 is a diagrammatic perspective view of the batter in the proper position after swinging the bat, showing proper follow through urged by the present invention.

FIG. 4 and FIG. 5 illustrate a training apparatus 10 that encourages and conditions a user 100, having a pair of hips 102, a waist, a pair of arms 106, a power arm and a leading arm, each arm with a wrist 108 and a shoulder 104, to correctly rotate the user's hips 102 as well as properly follow through with the user's arms, shoulders, and wrists when swinging a bat 120. The user's leading arm is the arm that faces a ball when the ball approaches the user and the user's power arm is the arm trailing that supplies force to the bat. The power arm is the arm that is generally referred to when one identifies the batting arm, such as for example, when a player is identified as a right-hand batter. The apparatus provides a method to train the user who is a softball or baseball batter to attain optimal biomechanics for most effectively hitting a ball. The apparatus conditions the user to maintain proper orientation of a plurality of body segments, such as the hips, shoulders, arms and wrists, by repeatedly restricting, guiding and urging movement in a correct direction and manner. FIGS. 4 and 5 show a training belt 20 worn by the user 100 above the user's hips 102, tethered to a telescopic support post 30, the post mounted on a platform 46, to align rotational and forward motion of the user's hips when standing on the platform 46, swinging the bat 120. In this embodiment, an elastic cord 50 connects a wrist strap 54 worn on the user's leading wrist 108 to the platform 46 with a sufficient amount of tension to compel the arm in a direction. The cord urges the user 100 to correctly follow through with the user's arms 106, wrists 108 and shoulders 104 so that the user 100 hits a ball in a desired direction.

Figure 2:
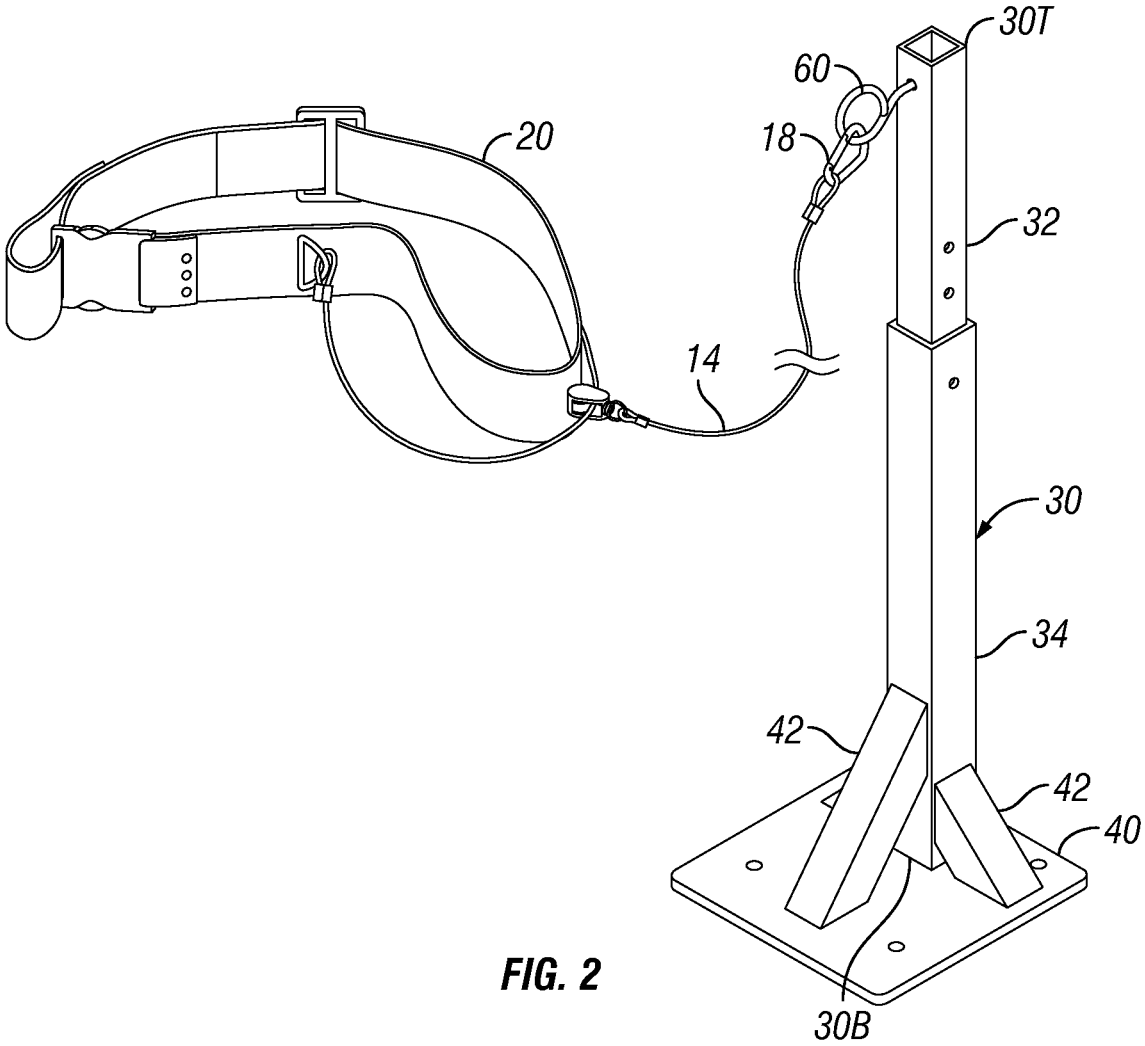
FIG. 2 is a diagrammatic perspective view of the training belt tethered to the telescopic support post.
Figure 3:
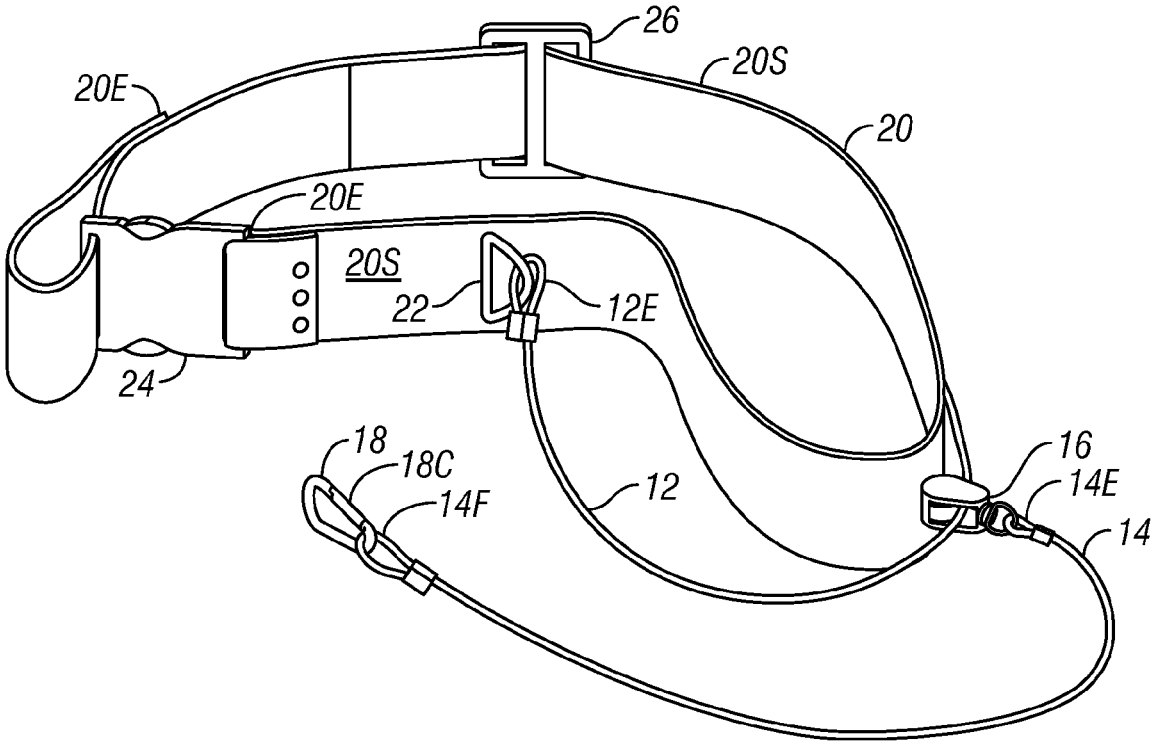
FIG. 3 is a diagrammatic perspective view of the training belt.

FIG. 3 shows the training belt 20 worn on the user's body, along with a flexible tether line 14 that is attached thereto. The training belt 20 is flexible and adjustable, made from, for example, but not limited to, leather or cloth that adjusts in length to snuggly fit the user around the waist over the hips. The training belt has a pair of exterior sides 20S substantially midway around the belt 20 from each other, and a pair of loops 22. The loops 22 are attached to the belt opposing each other, one on each side 20S, such that when the belt 20 is worn by the user and sits above the user's hips, one loop 22 is positioned on each side of the user. In the drawing, a D-ring loop 22 is illustrated, as a non-limiting example, but the loop may be, for example, a closed circle or other suitable shape known to those of ordinary skill. A flexible, elongated cable 12 having a length sufficient to extend behind and between the hips of the user, having a pair of end couplers 12E, is attached to the pair of loops 22, the cable 12 extending behind and between the hips. Means are provided for attaching one end coupler 12E of the cable 12 to one loop 22 and the other end coupler 12E of the cable 12 to the other loop 22. Attached to the cable 12 is the flexible tether line 14, having a pair of ends, including a first end 14F and a second end 14E. On the second end 14E, the tether line 14 is attached to the cable 12 by a pulley 16. The cable 12 extends through the pulley 16, and thereby allowing the tether line 14 to move along the cable 12 smoothly as the user rotates his hips when wearing the training belt 20. The first end 14F of the tether line 14 selectively attaches to a support post 30, which is described in further details with regard to FIG. 2 hereinbelow. The tether line 14 has a length sufficient to extend from the support post to the cable 12 when the cable 12 is secured behind and between the hips of the user and the user is in a desired batting position. The second end of the tether line 14 attaches to the support post by a coupling link 18 with a closure 18C that can be selectively opened and closed to attach and detach the tether line 14 to and from the support post.

The training belt 20 has a pair of ends 20E that are secured by tying or by a fastener 24, such as, for example, but not limited to, a buckle, a clasp, hook and loop fastener material or other means to adjustably and snuggly secure the required length around the user's waist. The training belt 20 optionally has a keeper 26 to facilitate adjustment and to hold back an excess length of the training belt 20 from interfering with the user.

FIG. 2 shows the training belt 20 attached by the tether line 14 to the support post 30, which has a top 30T and a bottom 30B. The tether line 14 is attached by the coupling link 18 to an eyebolt 60 at the top 30T of the support post 30. The support post 30 has an inner sliding 32 member and an outer fixed member 34 and is thereby telescopic so that it may be adjusted in height to accommodate small children and adult batters alike. When the height is adjusted, the eyebolt 60 at the top 30T of the support post 30 is substantially level with the training belt 20 when worn by the user. The support post 30 also has a base 40, and a plurality of angle braces 42 which ensure a solid connection to the platform 46, best seen in FIGS. 4 and 5. The braces connect angularly to the post stabilizing the support post.

FIGS. 4 and 5 shows the user 100 with the training apparatus 10 in place. The training apparatus 10 sits on a platform 46 that is about the size of a standard batter's box. The platform 46 has a rear edge 46B with a center 46C and a front edge 46F having a right front corner 46R and left front corner 46L, right and left being relative to the user's 100 perspective. The support post 30 is mounted substantially at the center 46C of the rear edge 46B of the platform 46. In one embodiment, an elastic cord 50 is attached to the left corner 46L on the front edge 46E for a user 100 who bats right-handed. The illustration shows the configuration for a right-handed batter, but to configure the training apparatus for a left-handed batter, the elastic cord would be attached to the right corner 46L on the front edge 46F. The elastic cord 50 has a pair of ends 50E, a first end 50E attached to the platform 46 and a second end 50E attached to a wrist strap 54. The user 100 grasps the wrist strap 54 with the leading arm before grasping the bat 120, pulling the elastic cord 50 to increase tension. The elastic cord 50 is adjusted at the first end 50E by shortening or lengthening to supply the necessary tension such that the force of the tension pulls the wrists 108, arms 106, and shoulders 104 forwardly, toward where a pitcher would be standing, to complete the stroke of the bat 120.

Figure 6:
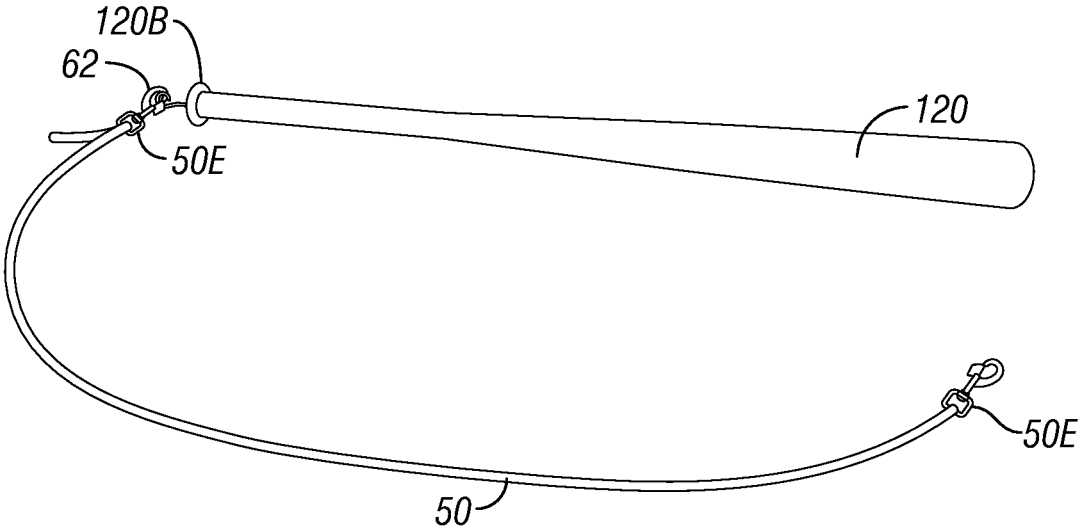
FIG. 6 is a diagrammatic perspective view of a bat with an elastic cord for attaching to a front portion of the platform.
Figure 7:
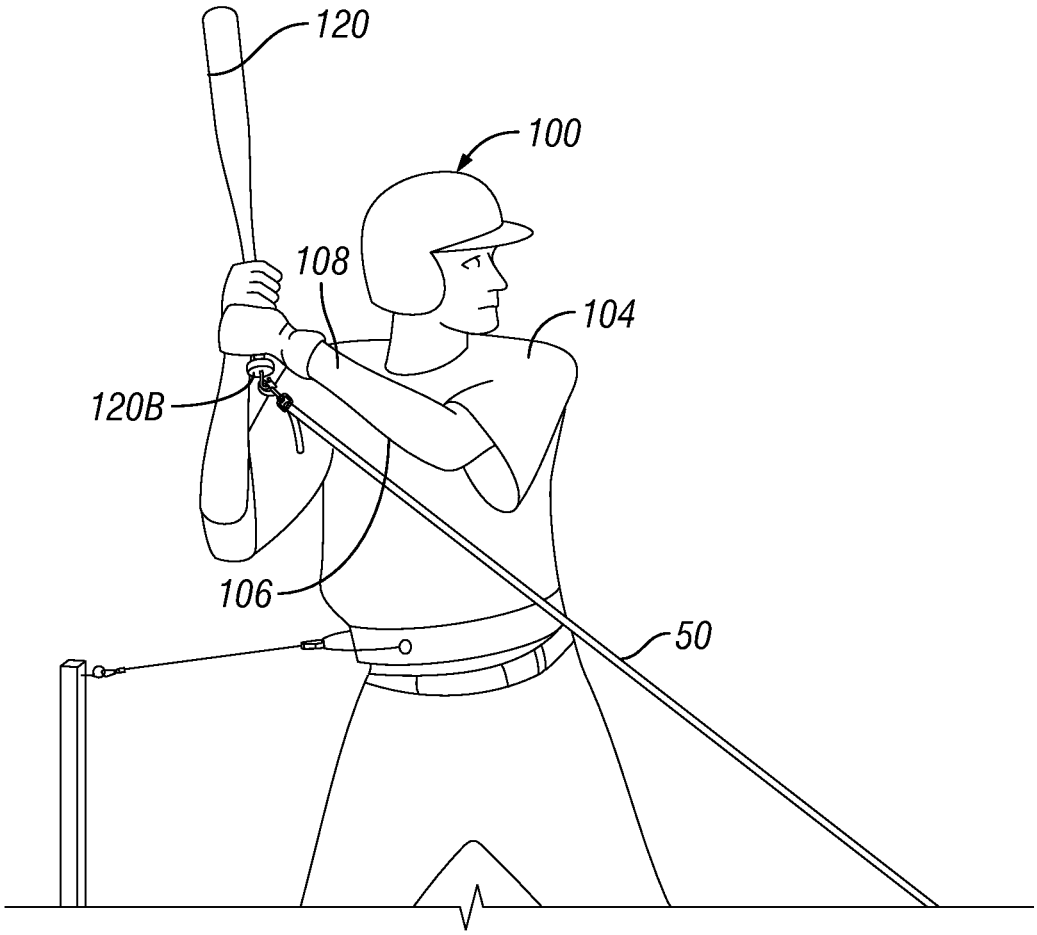
FIG. 7 is partial perspective view of a batter poised in the proper position in anticipation of swinging the bat, the bat attaching to the platform by the elastic cord.

In a further embodiment, as illustrated in FIG. 6, the first end 50E of the elastic cord 50 adjustably attaches to the bat 120, the bat having a bottom 120B with another eyebolt 62, the end of the cord attaching to the eyebolt 62. The eyebolt is selectively attached to the bat for training and selectively detached for regular play. The second end 50E of the cord selectively attaches to the platform as described hereinabove with respect to FIG. 4. FIG. 7 shows the user 100 grasping the bat 120, the cord extending from the bottom 120B of the bat. The elastic cord 50 is adjusted at the first end 50E by shortening or lengthening to supply the necessary tension such that the force of the tension pulls the wrists 108, arms 106, and shoulders 104 forwardly, in a counterclockwise motion to complete the stroke of the bat 120. The cord urges the user 100 to correctly follow through with the stroke of the bat so that the user 100 hits a ball in the desired direction.

Referring to FIG. 4, in yet a further embodiment, the training apparatus 10 sits on a platform 46 that is about the size of a standard teeing ground. The telescopic support post 30 is mounted substantially at the center 46C of the rear edge 46B of the platform 46. The user wears the training belt 20 around the waist above the hips. Instead of a bat, the user grasps a golf club. The user 100 grasps the wrist strap 54 with the leading arm before grasping the golf club, pulling the elastic cord 50 to increase tension. The training belt keeps the user's hip in a plane parallel to the platform while rotating through the swing. The elastic cord urges the shoulders, arms and wrist to correctly follow through the swing.

Figure 1:
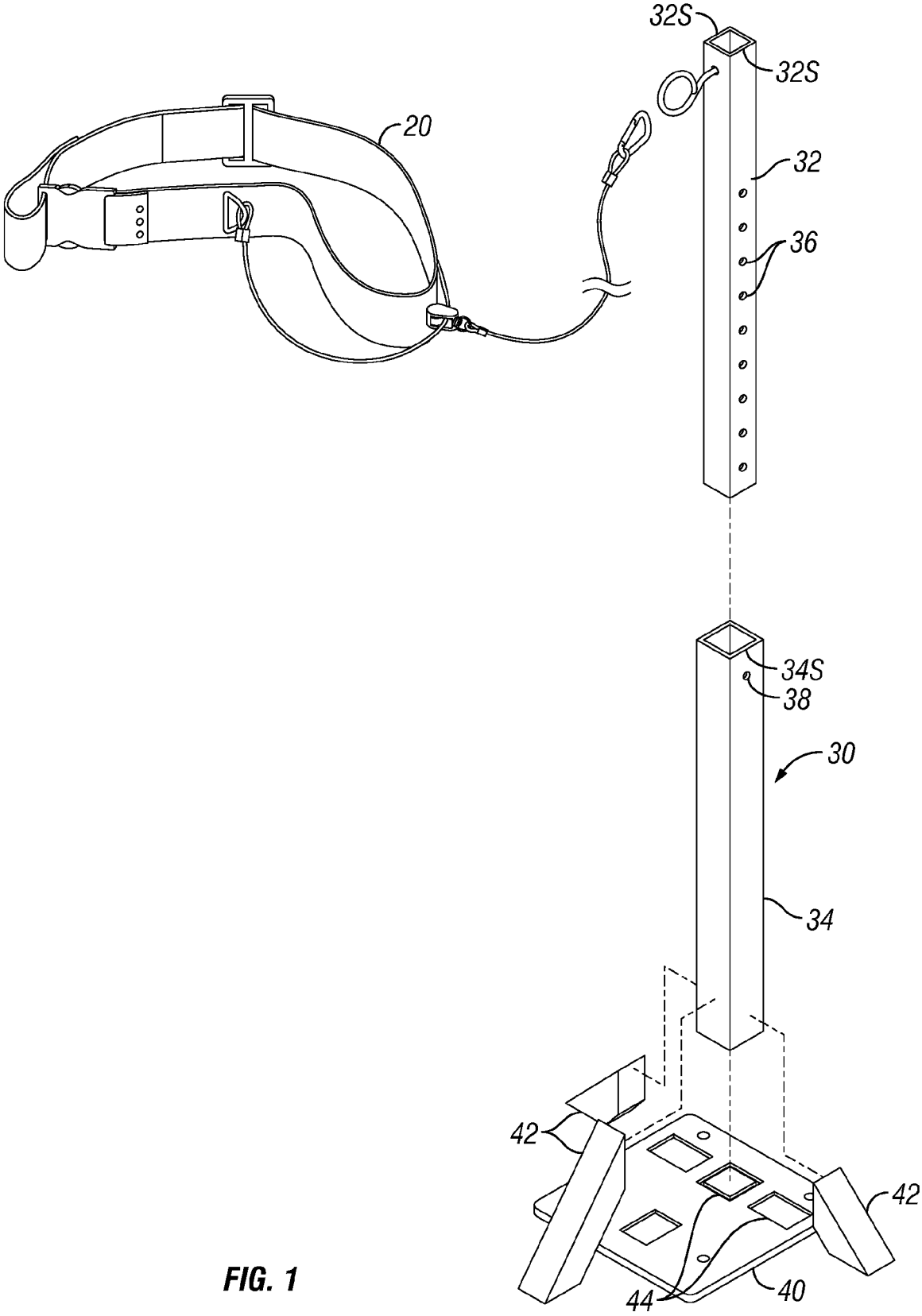
FIG. 1 is an exploded diagrammatic perspective view of a training belt tethered to a telescopic support post.

FIG. 1 shows in detail an exemplary construction of the support post 30. The inner sliding member 32 is hollow, fitting inside the hollow outer fixed member 34. The inner sliding member 32 has a plurality of sides 32S. A pair of sides 32S opposite each other have a plurality of adjustment openings 36 along the length of the member 32 and the positions of the adjustment openings 36 on one side align with the positions of the other adjustment openings 36 on the side opposite 32S. The fixed outer member 34 has a plurality of sides 34S, and a pair of fixed openings 38, one opening on each of opposing sides, the first fixed opening 38 aligned with the second fixed opening 38 to create a through channel. Height adjustment is accomplished by moving the sliding member 32 to the desired height while aligning the pair of adjustment openings 36 with the pair of fixed openings 38 on the fixed member 34 and inserting a locking pin through the aligned fixed openings and adjustment openings to lock the sliding member 32 in place. The fixed member and the sliding member are illustrated to be square in cross-section, but it is understood that other shapes in cross-section, such as a circle can be substituted. It is understood that this is one illustration of adjusting the telescopic support post and other systems of adjusting and securing telescopic posts are possible while adhering to the inventive concept.

FIG. 1 shows further details of the support post 30. The base 40 has a plurality of sockets 44, one for each of the braces 42 as well as the fixed member 34. The base 40 is attached to the platform, which is illustrated in FIGS. 4 and 5, where the braces 42 have been omitted for clarity of illustration.

FIGS. 4 and 5 also demonstrate a method of using the training apparatus 10. In particular, the training belt 20 is placed on the user's waist 112 above the hips 102, aligning the loops 22 so that one loop 22 is on each side of the user's body 110. The second end 14E of the tether line 14 is attached to the eye bolt 60 on the support post 10 and the height of the support post 10 is adjusted by sliding the inner member 32 up or down accordingly so that the tether line 14 is parallel to the platform 46. The user 100 stands forward of the support post 30 until the tether line 14 is substantially taut. The user 100 grasps the wrist strap 54 on the elastic cord 50 along with the bat 120. In a further embodiment, as shown in FIG. 7, the user attaches the elastic cord 50 to the bottom of the bat 120B. Referring to FIG. 4, the user 100 assumes a ready stance. The taut tether line 14 aligns the user's body 110 to be parallel to a line running from a home plate 130 to a pitcher's rubber, referring to the standard configuration of a baseball or softball field. The user 100 stands with a right hip 102R slightly forward with a bent right leg 116. The user raises the bat 120, pulling the elastic cord 50, creating tension in the cord 50.

The user 100 begins to swing by first rotating his hips 102, then his power shoulder 104 which causes the power arm 106 to rotate in a counterclockwise direction for the user 100 who bats right handed. Forward motion of the body 110 is prevented by the tether line 14 and instead, the forward force is transferred more efficiently to the bat 120 and subsequently to the ball. The cable 12 provided between the hips 102 encourages axial rotation of the hips 102, remaining in the same plane, efficiently transferring the rotation force created by the body to the bat 120. As the hips rotate, the tether line 14 slides on the cable 12 between the pair of loops 22 on the training belt 20, conditioning the user to 100 rotate the hips 102 sufficiently to transfer the force of the swing to the bat 120.

Once the hips 102 begin to rotate, the power shoulder 104 follows as the user's body 110 follows the hips 102. The power shoulder 104 causes the power arm 106 to rotate, accordingly slightly lagging behind the rotation of the hips 102. The elastic cord 50 pulls the leading arm 106 further into the rotation once the hips 102 have rotated as fully as the training belt 20 allows, preventing the user 100 from not completing the required follow through to efficiently transfer the power and direction of the swing.

FIG. 5 shows the user 100 in the proper position at the completion of the swing. The user 100 is still in the same position relative to the front edge 46F and rear edge 46B of the platform 46, having transferred all the forward motion to the bat 120 and not to moving the user's body 110 forward. The user's hips 102 have fully rotated so that the right hip 102R has rotated to be substantially parallel to the front edge 46F. The tension of the elastic cord 50 attached to the wrist strap 54 in one embodiment or to the bat in the further embodiment, has pulled the power arm 106 fully forward, completing the swing and efficiently transferring all the energy to the bat 120. The elastic cord 50 forces the arms 106 to position the bat 120 in parallel to the pitcher's rubber so that the ball travels in the desired direction.

All the illustrations show the training apparatus configured for a user who bats right-handed. It is understood that the training apparatus may be quickly and easily set up in a manner that is a mirror-image to the illustration for the user who bats left-handed or for the switch hitter. Expectedly, the platform is moved to the right of home plate 130 and the elastic cord is attached to the left corner on the front edge. The user rotates his hips, shoulder and arm in a clockwise rotation.

In conclusion, herein is presented a training apparatus and method for training baseball and softball batters to effectively swing the bat with a proper rotation of a player's hips and follow through with a player's arms, wrists and shoulders. The invention is illustrated by example in the drawing figures, and throughout the written description. It should be understood that numerous variations are possible, while adhering to the inventive concept. Such variations are contemplated as being a part of the present invention.

What is claimed is:

1. A free-standing batter training apparatus for training proper swinging of a bat, the training apparatus comprising:

a training belt, the training belt worn around a waist of a user, the training belt having a pair of sides positioned substantially midway on either side of the training belt, a pair of loops, attached to each side of the training belt, such that when the belt is worn on a waist of the user, one loop is on each side of the user's waist, the belt having an elongated cable with a pair of end couplers, the couplers attaching to the pair of loops on the training belt, the elongated cable extending behind and between the user's hips;

a movable free-standing platform substantially the size of a batter's box, the platform having a front end, a back end and a pair of sides;

a telescopic support post removably attached to the back end of the platform, the telescopic support post positioned substantially centrally on the rear end, the telescopic support post including an upper end and a lower end, wherein the support post can be telescopically adjusted such that the upper end of the support post can become level with the training belt when worn by the user;

a tether line having first and second ends, the first end selectively attachable to the upper end of the support post, a pulley attached to the second end, the elongated cable extending through the pulley attaching the training belt to the second end of the tether line, thereby allowing the tether line to move freely along a length of the elongated cable, thereby connecting the training belt and the elongated cable to the support post, forcing the user's hip to properly rotate while swinging a bat;

a wrist strap worn on the user's leading arm; and an elastic cord, the elastic cord having first and second ends, the first end attached to a corner of the front end of the platform opposite the user's power arm, and the second end connected to the wrist strap, the elastic cord having sufficient amount of tension so that the elastic cord urges proper follow through of the user's power arm and leading arm, while at the same time, the tether line forces proper rotation of the user's hip, wherein the elastic cord and the tether line together aid the user to maintain proper hip and arm orientation while swinging a bat.

2. The batter training apparatus as described in claim 1, wherein the telescopic support post has a plurality of sides and a plurality of angle braces angularly connecting the sides of the support post to the platform, each one of the plurality of angle brace is connected to only one side of the support post, wherein the plurality of angle braces add stability to the support post.

3. The batter training apparatus as described in claim 1, wherein the upper end of the support post includes an eyebolt and the first end of tether line attaches to the eyebolt.

4. A free-standing batter training apparatus for training proper swinging of a bat, the training apparatus comprising:

a bat having a handle portion and a barrel portion;

a training belt, the training belt worn around a waist of a user, the training belt having a pair of sides positioned substantially midway on either side of the training belt, a pair of loops, attached to each side of the training belt, such that when the belt is worn on a waist of the user, one loop is on each side of the user's waist, the belt having an elongated cable with a pair of end couplers, the couplers attaching to the pair of loops on the training belt, the elongated cable extending behind and between the user's hips;

a movable free-standing platform substantially the size of a batter's box, the platform having a front end, a back end and a pair of sides;

a telescopic support post removably attached to the back end of the platform, the telescopic support post positioned substantially centrally on the rear end, the telescopic support post including an upper end and a lower end, wherein the support post can be telescopically adjusted such that the upper end of the support post can become level with the training belt when worn by the user;

a tether line having first and second ends, the first end selectively attachable to the upper end of the support post, a pulley attached to the second end, the elongated cable extending through the pulley attaching the training belt to the second end of the tether line, thereby allowing the tether line to move freely along a length of the elongated cable, thereby connecting the training belt and the elongated cable to the support post, forcing the user's hip to properly rotate while swinging the bat;

an elastic cord, the elastic cord having first and second ends, when the user stands on the platform, the first end of the elastic cord attached to a front corner of the platform opposite the user's power arm, and the second end of the elastic cord connected to a bottom end of the bat handle, the elastic cord having sufficient amount of tension so that when the user's is holding the bat with his leading arm, the elastic cord urges proper follow through of the user's power arm and leading arm, while at the same time, the tether line forces proper rotation of the user's hip, wherein the elastic cord and the tether line together aid the user to maintain proper hip and arm orientation while swinging the bat.

5. The batter training apparatus as described in claim 4, wherein the telescopic support post has a plurality of sides and a plurality of angle braces angularly connecting the sides of the support post to the platform, each one of the plurality of angle brace is connected to only one side of the support post, wherein the plurality of angle braces add stability to the support post.

6. The batter training apparatus as described in claim 4, wherein the upper end of the support post includes an eyebolt and the first end of tether line attaches to the eyebolt.

* * * * *